US012168534B2

(12) United States Patent
Bonnain

(10) Patent No.: US 12,168,534 B2
(45) Date of Patent: Dec. 17, 2024

(54) PACKAGING MACHINE AND METHOD OF PACKAGING ARTICLES

(71) Applicant: WestRock Packaging Systems, LLC, Atlanta, GA (US)

(72) Inventor: Jean-Christophe Bonnain, Chateauroux (FR)

(73) Assignee: WestRock Packaging Systems, LLC, Atlanta, GA (US)

( * ) Notice: Subject to any disclaimer, the term of this patent is extended or adjusted under 35 U.S.C. 154(b) by 0 days.

(21) Appl. No.: 17/980,034

(22) Filed: Nov. 3, 2022

(65) Prior Publication Data

US 2023/0047750 A1 Feb. 16, 2023

Related U.S. Application Data

(63) Continuation of application No. 16/605,116, filed as application No. PCT/US2018/018666 on Feb. 20, 2018, now Pat. No. 11,505,348.

(Continued)

(51) Int. Cl.

*B65B 21/04* (2006.01)
*B65B 35/16* (2006.01)

(Continued)

(52) U.S. Cl.

CPC ..... *B65B 21/04* (2013.01); *B65B 35/16* (2013.01); *B65B 35/58* (2013.01); *B65B 43/54* (2013.01); *B65B 57/14* (2013.01)

(58) Field of Classification Search

CPC ..... B65B 21/04; B65B 43/54; B65B 57/14; B65G 47/918; B65G 47/24; B65G 47/244

See application file for complete search history.

(56) References Cited

U.S. PATENT DOCUMENTS 4,428,474 A 1/1984 Gau et al.
5,215,180 A * 6/1993 Allard ..... B65G 47/918 198/395

(Continued)

FOREIGN PATENT DOCUMENTS

EP 1584559 A1 10/2005
WO 2008/036745 A1 3/2008
WO 2014/052517 A1 4/2014

OTHER PUBLICATIONS

International Search Report issued in PCT/US2018/018666, dated May 14, 2018.

*Primary Examiner* — Thomas M Wittenschlaeger
(74) *Attorney, Agent, or Firm* — Brian J. Goldberg; Rohini K. Garg

(57) ABSTRACT

Aspects of the disclosure relate to a packaging machine for packaging articles, apparatus for a packaging machine and to a method of packaging articles. The packaging machine comprises an article manipulation apparatus. The article manipulation apparatus comprises a first conveyor for conveying packages. The packages each comprises a carton having at least one displaceable article disposed therein. An article orientation device comprises a tool head movable synchronously in a downstream direction with the first conveyor. The tool head has at least one article gripper for engaging with a displaceable article in the carton. The at least one article gripper is rotatably mounted to the tool head. An article displacement device comprises at least one article displacement tool. The article displacement tool is receivable in an opening in a carton to engage and displace the displaceable article such that it protrudes through a second opening in said carton.

17 Claims, 12 Drawing Sheets

Related U.S. Application Data

(60) Provisional application No. 62/486,696, filed on Apr. 18, 2017.

(51) Int. Cl.

| | |
|---|---|
| ***B65B 35/58*** | (2006.01) |
| ***B65B 43/54*** | (2006.01) |
| ***B65B 57/14*** | (2006.01) |

(56) References Cited

U.S. PATENT DOCUMENTS

| | | | | |
|---|---|---|---|---|
| 5,919,028 | A | 7/1999 | Edqvist | |
| 6,868,652 | B2 | 3/2005 | Arends et al. | |
| 7,870,943 | B2 | 1/2011 | Malini | |
| 8,973,733 | B2 | 3/2015 | Fredrickson et al. | |
| 10,710,767 | B2 | 7/2020 | Merzeau | |
| 2009/0218193 | A1* | 9/2009 | Malini | B65G 47/24 198/395 |
| 2010/0192515 | A1 | 8/2010 | Chalendar et al. | |
| 2015/0210414 | A1 | 7/2015 | Avril et al. | |
| 2015/0344162 | A1 | 12/2015 | Bonnain et al. | |
| 2017/0203865 | A1 | 7/2017 | Kalany et al. | |
| 2017/0210572 | A1* | 7/2017 | Alberti | B65G 43/08 |

* cited by examiner

PACKAGING MACHINE AND METHOD OF PACKAGING ARTICLES

CROSS REFERENCE TO RELATED APPLICATIONS

This application is a Continuation of U.S. patent application Ser. No. 16/605,116, filed Oct. 14, 2019, which application is a 371 U.S. National Stage Entry of International PCT Patent Application No. PCT/US2018/018666, filed Feb. 20, 2018, which application claims priority to U.S. Provisional Patent Application No. 62/486,696, filed Apr. 18, 2017, the entire contents of which are incorporated herein by reference.

TECHNICAL FIELD

The present invention relates to a packaging machine and to a method of packaging articles in cartons. More specifically, but not exclusively, the invention relates to a method of orienting an article within a carrier for display in a display window provided in the carton.

BACKGROUND

In the field of packaging it is known to provide cartons for carrying multiple articles. Cartons are well known in the art and are useful for enabling consumers to transport, store and access a group of articles for consumption. For cost and environmental considerations, such cartons or carriers need to be formed from as little material as possible and cause as little wastage in the materials from which they are formed as possible. Further considerations are the strength of the carton and its suitability for holding and transporting large weights of articles. It is desirable that the contents of the carton are secure within the carton.

It is an object of the present disclosure to provide a packaging machine and method of packaging in which the orientation of an article can be adjusted whilst within an article carrier, the article carrier comprising a display window for displaying the article within the carrier.

The present invention seeks to provide an improvement in the field of packaging articles in cartons, typically formed from paperboard or the like.

SUMMARY

A first aspect of the invention provides a packaging machine comprises an article manipulation apparatus. The article manipulation apparatus comprises a first conveyor for conveying packages. The packages each comprise a carton having at least one displaceable article disposed therein. An article orientation device comprises a tool head movable synchronously in a downstream direction with the first conveyor. The tool head has at least one article gripper for engaging with a displaceable article in a carton. The at least one article gripper is rotatably mounted to the tool head. An article displacement device comprises at least one article displacement tool. The article displacement tool is receivable in an opening in a carton to engage and displace the displaceable article such that it protrudes through a second opening in said carton. The at least one article displacement tool is movable synchronously in a downstream direction with the first conveyor. The article orientation device comprises at least one sensor for determining the orientation of the displaceable article and a drive mechanism for rotating the at least one article gripper so to place the displaceable article in a predefined orientation.

Optionally, the article displacement apparatus comprises a first working reaching and the article displacement apparatus engages with an article over the first working reach so that the article protrudes from the carton.

Optionally, the article orientation device comprises a second working reach, each of the at least one article grippers being moveable in synchronicity with a respective one of the at least one article displacement tools over the second working reach.

Optionally, the carton comprises a plurality of panels forming walls of a tubular structure including a top wall, a first side wall, a base wall, and a second side wall, the carton comprises a top opening defined at least in the top wall for receiving an upper portion of said displaceable article and a bottom opening defined at least in the base wall to access said displaceable article to raise and lower the elevation thereof such that the upper portion of the said displaceable article is movable upward and downward through the top opening.

Optionally, the carton comprises a display window defined at least in the first side wall for display of said displaceable article.

Optionally, the packages are continuously moved in a downstream direction upon the first conveyor through the article manipulation apparatus.

Optionally, the carton comprises at least one further article, the carton being configured to inhibit displacement of said at least one further article.

A second aspect of the invention provides a method of packaging one or more articles comprising:

- providing at least one article in a carton, the carton comprising a plurality of panels forming walls of a tubular structure including a first wall, a second wall opposing the first wall, the first and second wall being spaced apart by at least a third wall, a first opening defined at least in the first wall for receiving a portion of said article and a second opening defined at least in the second wall to access a displaceable article within the carton;
- inserting a first tool, through the second opening, into the carton so as to engage with the displaceable article;
- pushing the displaceable article from an initial position so as to displace it with respect to the carton such that a portion of the displaceable article protrudes though the first opening;
- engaging a protruding portion of the displaceable article with a second tool;
- determining the orientation of the displaceable article with respect to the carton; and
- rotating the second tool so as to rotate the displaceable article into a desired orientation with respect to the carton.

Optionally, the method comprises disengaging the protruding portion of the displaceable article.

Optionally, the method comprises withdrawing the first tool from the carton so as to return the displaceable article to the initial position, wherein in the initial position the displaceable article is disposed within an interior chamber of the carton.

A third aspect of the invention provides an article manipulation apparatus for a packaging machine, the article orientation apparatus comprising:

- a first conveyor for conveying packages, the packages each comprising a carton having at least one displaceable article disposed therein;

an article orientation device comprising a tool head movable synchronously in a downstream direction with the first conveyor wherein the tool head has at least one article gripper for engaging with a displaceable article in a carton, the at least one article gripper is rotatably mounted to the tool head;

an article displacement device comprising at least one article displacement tool, the article displacement tool is receivable in an opening in a carton to engage and displace the displaceable article such that it protrudes through a second opening in said carton, wherein the at least one article displacement tool is movable synchronously in a downstream direction with the first conveyor;

at least one sensor for determining the orientation of the displaceable article; and a drive mechanism for rotating the at least one article gripper so to place the displaceable article in a predefined orientation.

Within the scope of this application it is envisaged that the various aspects, embodiments, examples, features and alternatives set out in the preceding paragraphs, in the claims and/or in the following description and drawings may be taken independently or in any combination thereof. For example, features described in connection with one embodiment are applicable to all embodiments unless there is incompatibility of features.

BRIEF DESCRIPTION OF THE DRAWINGS

Embodiments of the invention will now be described with reference to the accompanying drawings, in which.

DETAILED DESCRIPTION OF EMBODIMENTS

Detailed descriptions of specific embodiments of the packaging machine, apparatus, method, packages, blanks and cartons are disclosed herein. It will be understood that the disclosed embodiments are merely examples of the way in which certain aspects of the invention can be implemented and do not represent an exhaustive list of all of the ways the invention may be embodied. As used herein, the word "exemplary" is used expansively to refer to embodiments that serve as illustrations, specimens, models, or patterns. Indeed, it will be understood that the packaging machine, apparatus, method, packages, blanks and cartons described herein may be embodied in various and alternative forms. The Figures are not necessarily to scale and some features may be exaggerated or minimised to show details of particular components. Well-known components, materials or methods are not necessarily described in great detail in order to avoid obscuring the present disclosure. Any specific structural and functional details disclosed herein are not to be interpreted as limiting, but merely as a basis for the claims and as a representative basis for teaching one skilled in the art to variously employ the invention.

Figure 7:
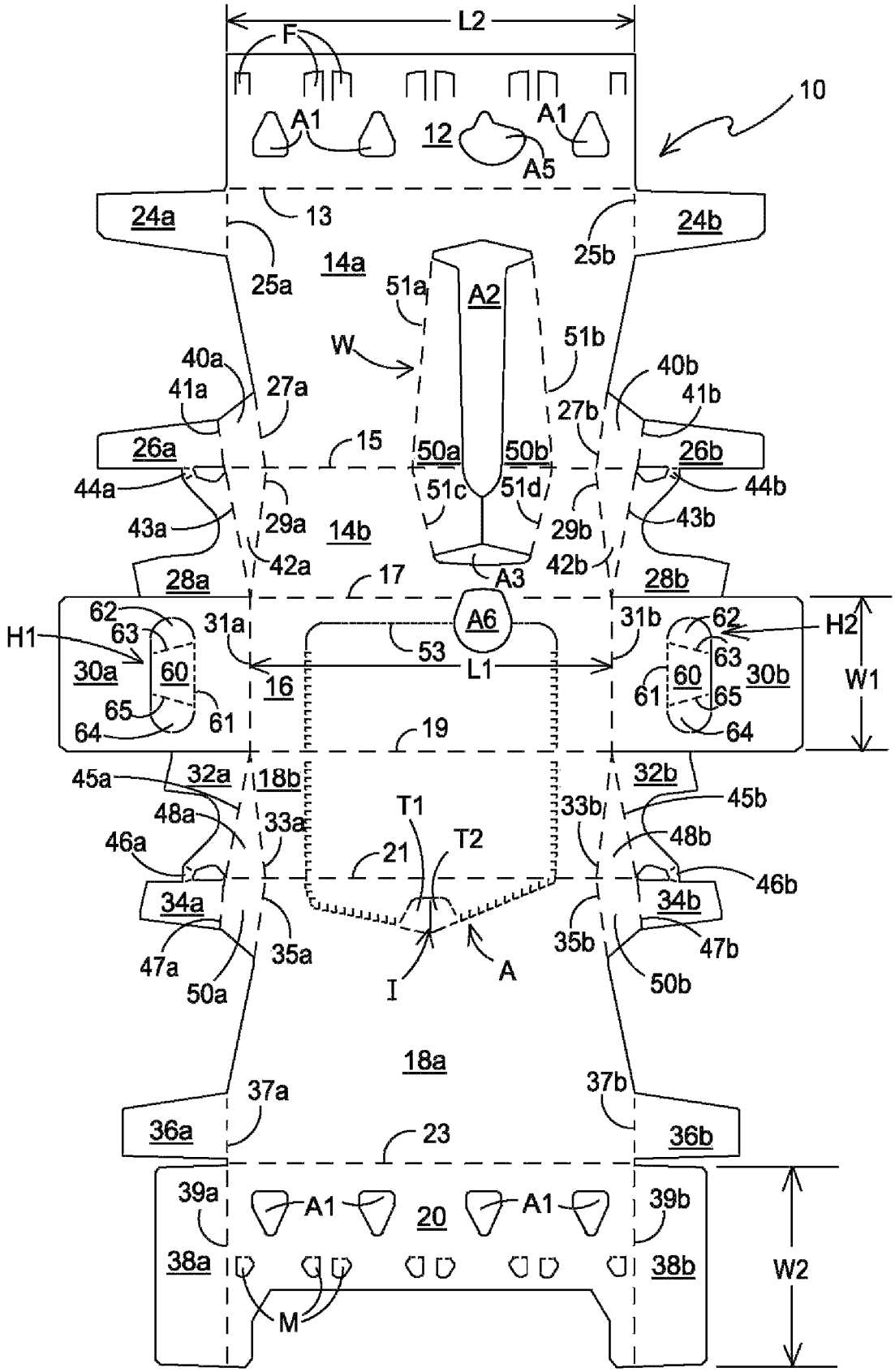
FIG. 7 is a plan view from above of a blank for forming a carton for use with the subsystem of FIG. 1 according to an embodiment of the disclosure.
Figure 8:
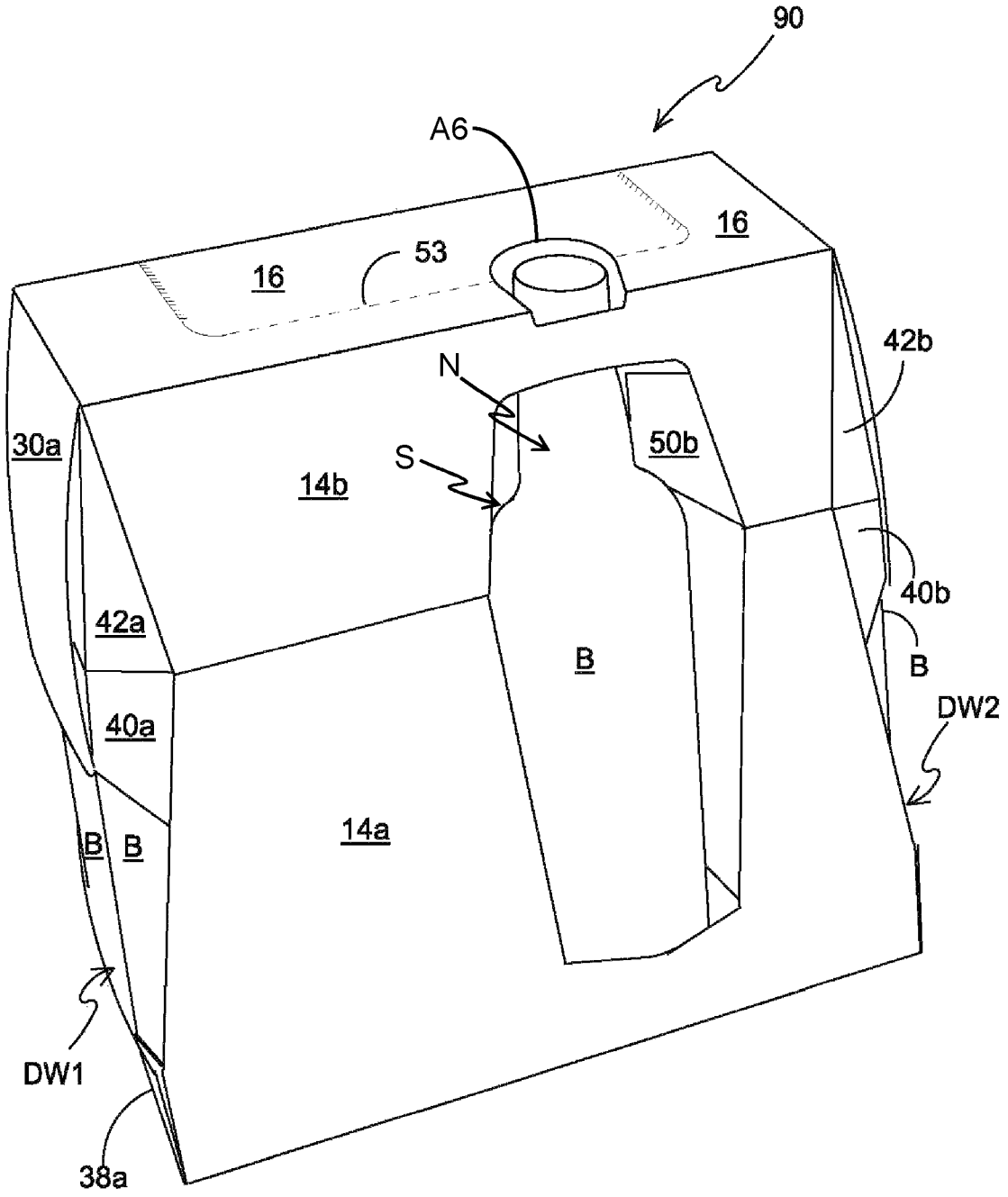
FIGS. 8 and 9 are perspective views from above of a carton formed from the blank of FIG. 1.
Figure 10:
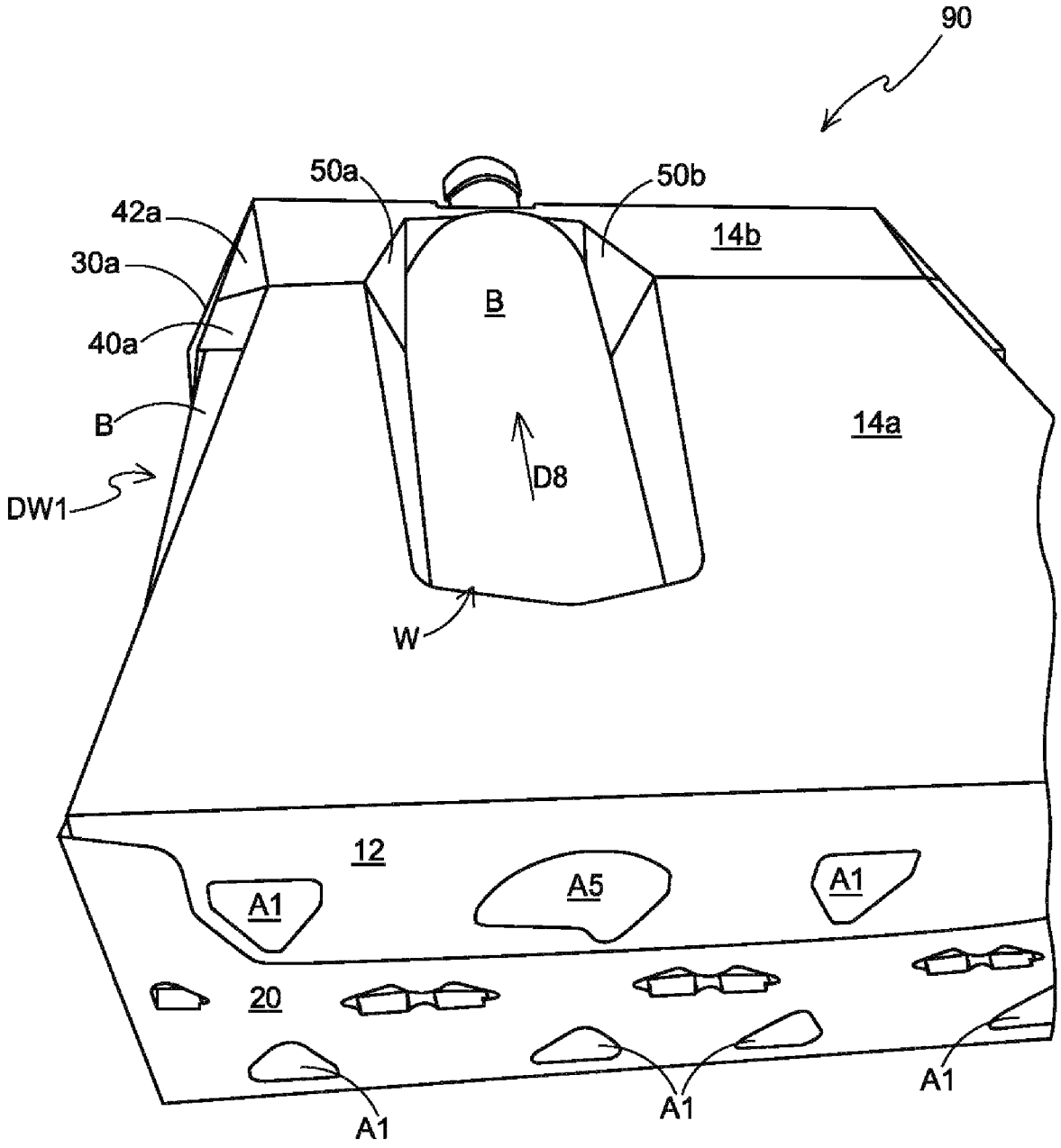
FIGS. 10 and 11 are further perspective views of the carton of FIG. 2 in which a displayed article has been manipulated within the carton such that its orientation is adjustable.
Figure 11:
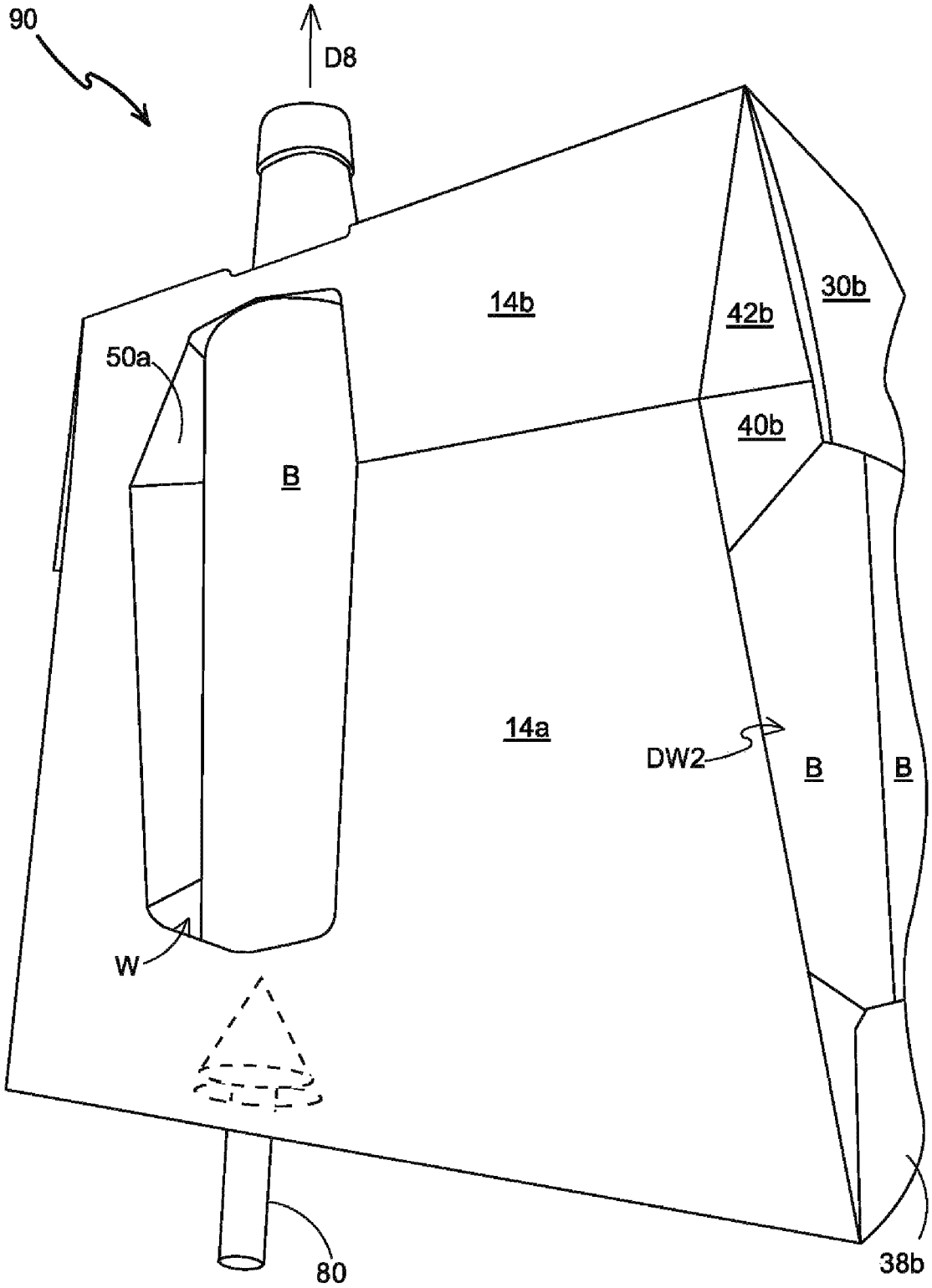
Figure 12:
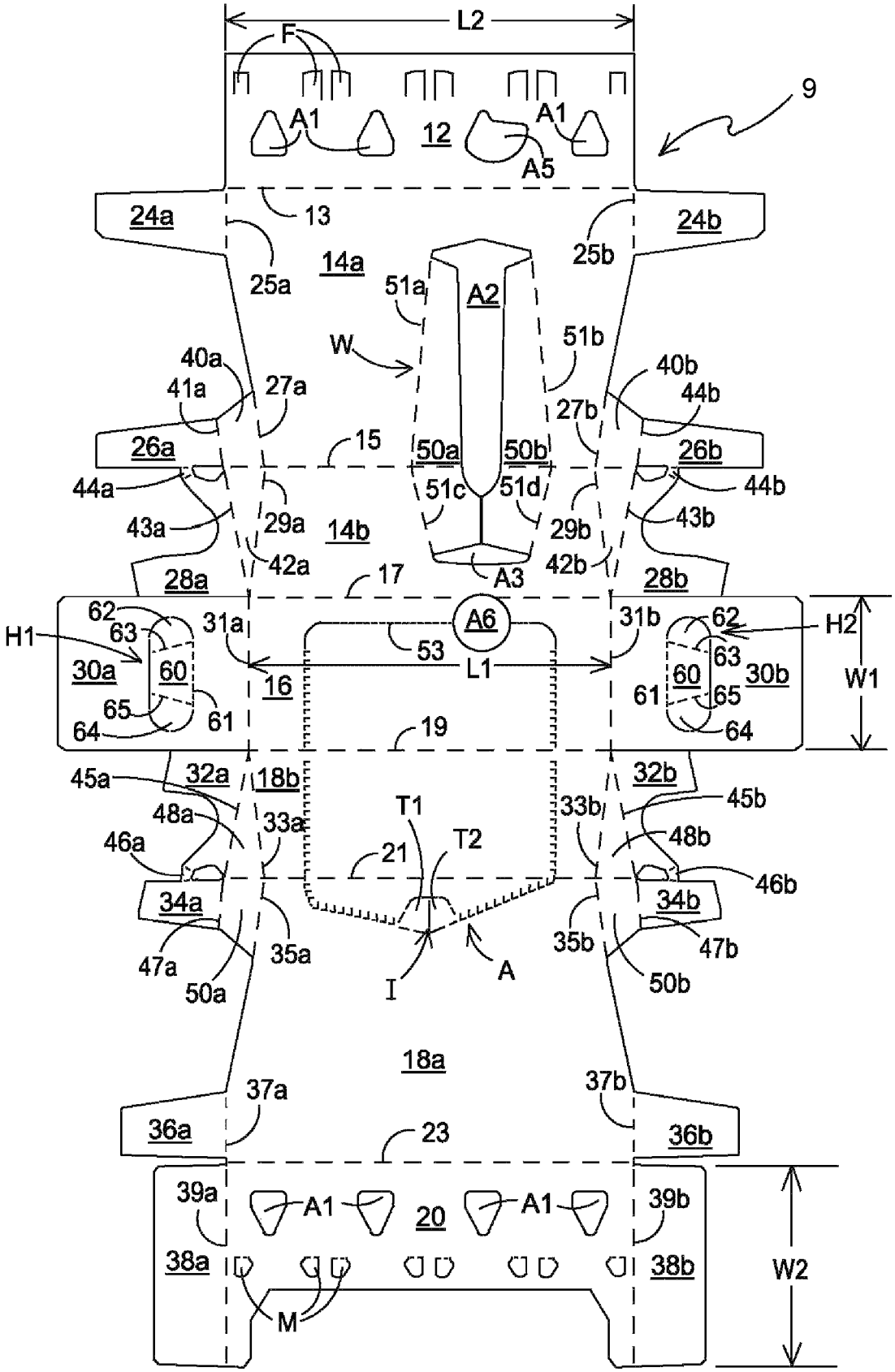
FIG. 12 is a plan view from above of a blank for forming a carton for use with the subsystem of FIG. 1 according to an alternative embodiment of the disclosure.

Referring to FIG. 7, there is shown a plan view of a blank 10 capable of forming a carton or carrier 90, as shown in FIGS. 8 to 11, for containing and carrying a group of primary products such as, but not limited to, bottles or cans, hereinafter referred to as articles B, as shown in FIG. 8. The blank 10 forms a secondary package for packaging at least one primary product container or package. FIG. 12 illustrates a plan view of an alternative blank 9 capable of forming an alternative carton or carrier.

In the embodiments detailed herein, the terms "carton" and "carrier" refer, for the non-limiting purpose of illustrating the various features of the invention, to a container for engaging and carrying articles B, such as primary product containers. It is contemplated that the teachings of the invention can be applied to various primary product containers, which may or may not be tapered and/or cylindrical. Exemplary primary product containers include bottles (for example metallic, glass or plastics bottles), cans (for example aluminium cans), tins, pouches, packets and the like.

The blanks 10, 9 are formed from a sheet of suitable substrate. It is to be understood that, as used herein, the term "suitable substrate" includes all manner of foldable sheet material such as paperboard, corrugated board, cardboard, plastic, combinations thereof, and the like. It should be recognised that one or other numbers of blanks may be employed, where suitable, for example, to provide the carrier structure described in more detail below.

The packaging structures or cartons described herein may be formed from a sheet material such as paperboard, which may be made of or coated with materials to increase its strength. An example of such a sheet material is tear-resistant NATRALOCK® paperboard made by WestRock Company. It should be noted that the tear resistant materials may be provided by more than one layer, to help improve the tear-resistance of the package. Typically, one surface of the sheet material may have different characteristics to the other surface. For example, the surface of the sheet material that faces outwardly from a finished package may be particularly smooth and may have a coating such as a clay coating or other surface treatment to provide good printability. The surface of the sheet material that faces inwardly may, on the other hand, be provided with a coating, a layer, a treatment or be otherwise prepared to provide properties such as one or more of tear-resistance, good glue-ability, heat sealability, or other desired functional properties.

In the illustrated embodiment, the blanks 10, 9 are configured to form a carton or carrier 90 for packaging an exemplary arrangement of exemplary articles B. In the embodiment illustrated the arrangement is a 4×2 matrix or array; in the illustrated embodiment two rows of four articles are provided, and the articles B are 16 oz (approx. 473 ml) aluminium bottles. Alternatively, the blanks 10, 9 can be configured to form a carrier for packaging other types, number and size of articles and/or for packaging articles in a different arrangement or configuration.

The present invention relates generally to a packaging machine 100 comprising an article manipulation apparatus or orientation station 101 for orienting an article B within a carton 90, wherein the carton 90 may comprise an article display arrangement for presentation of the article B whilst within the carton 90. The carton embodiments described herein may comprise a viewing window arrangement or display window W struck from a side wall of the carton, which window presents for view a substantial portion of an article B contained within the carton, adjacent to that side wall. The embodiments described herein may also comprise a viewing window arrangement or display window DW1, DW2 in at least one end wall.

Figure 1:
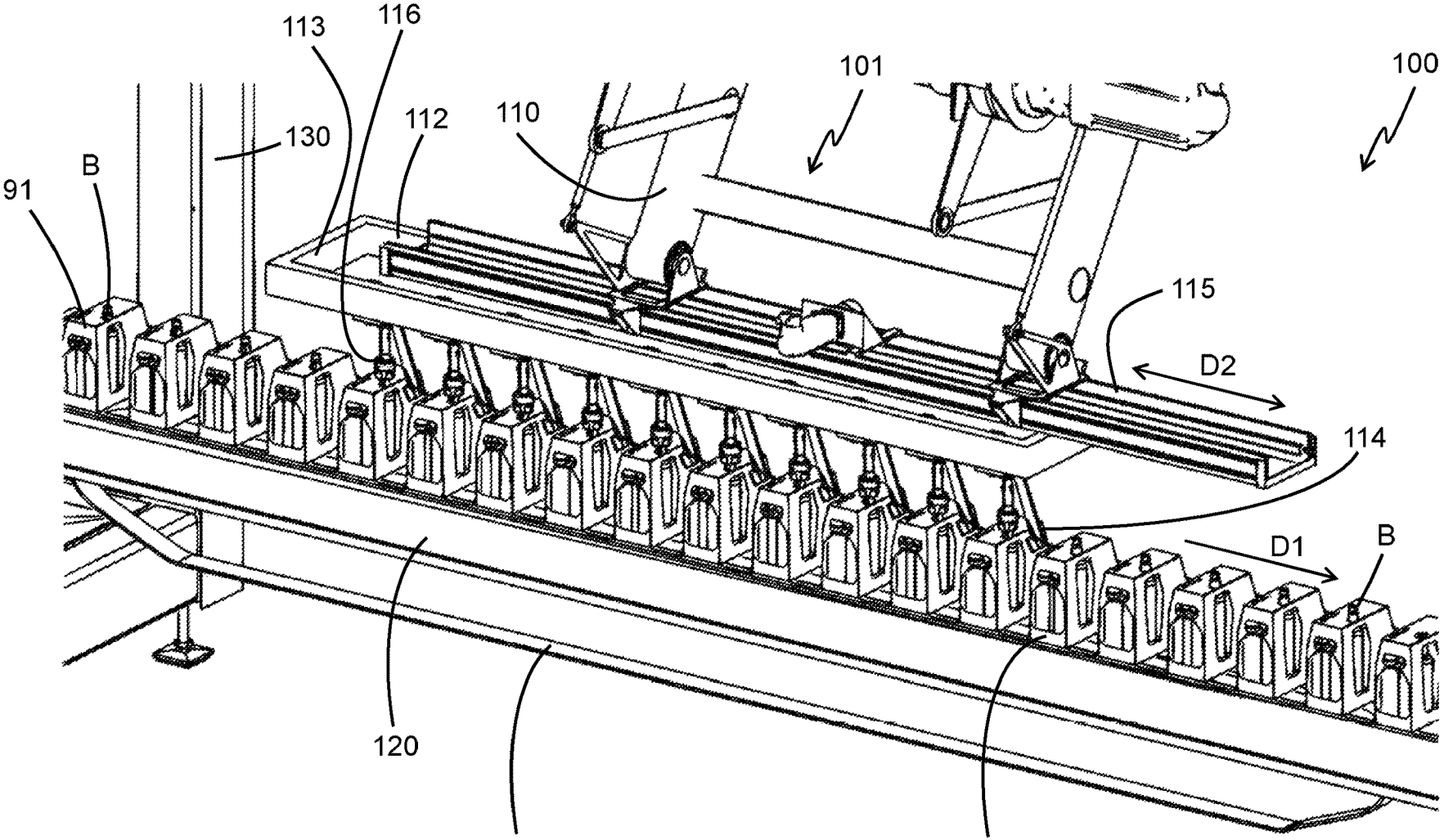
FIG. 1 is a perspective view of subsystem of a packaging machine, the provides an orientation station for controlling the orientation of an article with a carton or carrier.

FIG. 1 illustrates a packaging machine 100, the packaging machine 100 comprises a first conveyor 120. The first conveyor 120 conveys articles B in a downstream direction (indicated by direction arrow D1 in FIG. 1). The articles B are packaged into carton or carriers 90 (see FIG. 8) at a packaging station 130. Assembled packages 91 exit from a downstream end of the packaging station 130. The first conveyor 120 transfers the packages 91 to the article manipulation apparatus 101. The article manipulation apparatus 101 comprises an orientation tool 110. The orientation tool 110 is disposed over the first conveyor 120 above the packages 91. The orientation tool 110 comprises a tool head 112. The tool head 112 is linearly translatable in the upstream and downstream direction as indicated by direction arrow D2. The tool head 112 may take the form of a chassis 113 slideably mounted upon a track 115. A motor or other suitable drive mechanism is provided to move the chassis 113 with respect to the track 115.

The tool head 112 comprises at least one article gripper 116. Optionally, the tool head 112 comprises a plurality of article grippers 116 so as to be able to engage multiple articles B simultaneously. The illustrated embodiment comprises ten article grippers 116, although other embodiments may comprise more or less article grippers 116.

The article grippers 116 each comprise a cup for engaging an upper portion of an article B, the upper portion may be received in the cup. The cup frictionally engages with the article B. The article grippers 116 are rotationally mounted to the tool head 112. In some embodiments, each article gripper 116 may be rotated independently of the other article grippers 116 such that each article B can be rotated until the articles B reach a predefined orientation with respect to the package 91 in which it is disposed. In other embodiments, each article gripper 116 may be adapted such they can disengage and/or engage with the articles B independently of the other article grippers 116. In this way the period of time each article gripper is in engagement with an article B can be controlled individually. The period of time being dependent upon the degree of rotation any given article B requires in order to be placed in the predefined orientation. In still other embodiments the speed of rotation may be individually controllable for each article gripper 116.

The tool head 112 comprises a sensor 114 for determining and/or monitoring the orientation of each article B engaged by the tool head 112. In the illustrated embodiment as sensor is provided for each article gripper 116. The sensor 114 may take the form of a camera, vision sensor, image sensor, photo detector, CMOS sensor, CCD sensor or other suitable detector. The sensors 114 may each include a light source, such as but not limited to a Light Emitting Diode (LED) for illuminating the field of view of the sensor.

Each of the sensors 114 generates a signal that changes in accordance with the perceived surface features (such as colour, texture and reflectivity, amongst others) of a portion of the articles B engaged by the article gripper 116. A controller (not shown) receives these generated signals, processes the signal and takes appropriate action to rotate each of the articles B in question to a desired orientation. The controller may employ an image recognition program or software application to identify a predetermined visual detail or indicia, such as but not limited to text, graphics, a symbol or barcode. Optionally, the controller may comprise a display device for the display of information to an operator, and one or more input devices for input of information by an operator. The input devices may take the form of, but are not limited to, a keyboard, computer mouse, trackpad, joystick, or touch screen.

In some embodiments, the controller is configured to calculate the angular rotation required to place the articles B In the desired orientation.

In other embodiments, the controller is configured to observe or monitor the orientation of the articles B as they are rotated and to control the article grippers 116 so as to cease rotation when the desired orientation is reached.

Each sensor 114 captures information indicative of the orientation of a respective article B in engagement with an article grippers 116.

The controller is in communication (wired or wirelessly) with each sensor 114, and with a drive motor associated with each article gripper 116 and/or with a grip actuator coupled to the article gripper 116; the grip actuator can be activated to either engage the article gripper 116 with an article B or to disengage the article gripper 116 from an article B. In some embodiments, the grip actuator may take the form of a piston/cylinder arrangement or may be a valve in a pneumatic, vacuum or hydraulic system. The controller can determine the current orientation of the articles B in each of the rotatable article grippers 116. The controller controls the drive motors or grip actuator so as to individually rotate each rotatable article gripper 116 so as to place each of the articles B engaged therein in a desired or predefined orientation.

In order that the article grippers 116 can engage with an article B whilst disposed in a package 91 the carton 90 is adapted such that an article B, whose orientation it is desired to control, can be brought into a condition in which a portion of the article B is disposed externally of the carton 90. FIGS. 7 to 11 illustrate a blank 10 and carton 90 according to one embodiment of the present disclosure which facilitates displacement of an article B in order to at least partially expose a portion outside the carton 90. FIG. 12 illustrate a blank 9 according to an alternative embodiment which may be employed with the packaging machine 100.

Turning to FIG. 7, there is illustrated a blank 10 for forming a carton 90 according to a first embodiment. The blank 10 comprises a plurality of main panels 12, 14*a*, 14*b*, 16, 18*b*, 18*a*, 20 for forming a tubular structure. The plurality of main panels 12, 14*a*, 14*b*, 16, 18*b*, 18*a*, 20 comprises a first base panel 12, a first lower side panel 14*a*, a first upper side panel 14*b*, a top panel 16, a second upper side panel 18*b*, a second lower side panel 18*a* and a second base panel 20. The plurality of panels 12, 14*a*, 14*b*, 16, 18*b*, 18*a*, 20 may be arranged in a linear series hinged one to the next by corresponding fold lines 13, 15, 17, 19, 21, 23. The first upper side panel 14*b* and the first lower side panel 14*a* form a first side wall 14*a*/14*b* of a carton 90. The second upper side panel 18*b* and the second lower side panel 18*a* form a second side wall 18*a*/18*b* of a carton 90.

The blank 10 is foldable to form a carton 90 as illustrated in FIGS. 8 to 11. The first and second base panels 12, 20 are engageable with one another in an overlapping relationship to form a composite base wall 12/20 of the carton 90. The blank 10 may comprise a complementary locking mechanism for securing the second base panel 20 to the first base panel 12. The first base panel 12 may comprise at least one first part F of the complementary locking mechanism. The second base panel 20 may comprise at least one second part M of the complementary locking mechanism. In the illustrated embodiment, the first base panel 12 comprises a plurality of female tabs F defining openings in the first base panel 12. The second base panel 20 comprises a plurality of male tabs M, the openings in the first base panel 12 being configured to receive a respective one of the male tabs M. The female tabs F are arranged to be displaced out of the first base panel 12 to form the opening and to bear against the male tabs M when received therein.

The first and second base panels 12, 20 may comprise at least one first aperture A1. In the illustrated embodiment, each of the first and second base panels 12, 20 comprises four first apertures A1. The first apertures A1 may be employed to facilitate construction of the carton 90. A packaging machine component may engage with the first apertures A1 to enable the plurality of panels 12, 14*a*, 14*b*, 16, 18*b*, 18*a*, 20 to be tightened about a group of articles B. The first apertures A1 may also be employed to facilitate alignment of the first and second base panels 12, 20 with respect to each other or to align the first part of the complementary locking mechanism with the second part of the complementary locking mechanism. The complementary locking mechanism illustrated and described is entirely optional.

The blank 10 comprises at least one display window W for presentation of an article B.

Optionally, the blank 10 comprises a display window W formed in each of the first upper and first lower side walls 14*b*, 14*a*.

The display window W comprises an opening in each of the first upper and first lower side walls or panels 14*b*, 14*a*. The opening is defined in part by a first displaceable tab or flap 50*a*, in part by a second displaceable tab or flap 50*b*, in part by a second aperture A2 struck in part from the first upper side wall 14*b* and the first lower side wall 14*a* and in part by a third aperture A3 struck from the first upper side wall 14*b*. The first and second displaceable flaps 50*a*, 50*b* are separated from each other in part by the second aperture A2 and in part by a severable line in the form of a cutline. The third aperture A3 defines upper edges of each of the first and second displaceable flaps 50*a*, 50*b*. The cutline extends between the second aperture A2 and the third aperture A3. The first and second displaceable flaps 50*a*, 50*b* are hinged to the first lower side panel 14*a* by fold lines 51*a*, 51*b* respectively. The first and second displaceable flaps 50*a*, 50*b* are hinged to the first upper side panel 14*b* by fold lines 51*c*, 51*d* respectively. The fold line 51*a* is contiguously arranged with the fold line 51*c* and the fold line 51*b* is convergently arranged with respect to the fold line 51*d*. The fold line 51*a* and the fold line 51*c* define an oblique angle therebetween. The fold line 51*b* is contiguously arranged with the fold line 51*d* and the fold line 51*b* is convergently arranged with respect to the fold line 51*d*. The fold line 51*b* and the fold line 51*d* define an oblique angle therebetween.

The first and second displaceable flaps 50*a*, 50*b* are hingedly connected to the first upper and first lower side walls 14*b*, 14*a* and are positioned opposite to one another.

In this way the fold lines 51*a*, 51*b*, 51*c*, 51*d*, in the illustrated embodiment, are non-linear hinged connections. In other embodiments the fold lines may be curvilinear or arcuate or may be comprised of two or more linear portions arranged contiguously and divergently with respect to each other.

When the tabs 50*a*, 50*b* are displaced to display an article B as shown in FIG. 8, the non-linear hinged connection increases or encourages the tendency of the displaceable tabs 50*a*, 50*b* to return to their original, unfolded, planar position. In this way the tabs 50*a*, 50*b*, when displaced, are biased towards the article B displayed within the window W. The tabs 50*a*, 50*b* form a frame about the displayed article B and may at least partially separate the displayed article B from adjacent articles B in the row of articles B proximate the first side panel 14*a*/14*b*. The tabs 50*a*, 50*b* may at least partially conceal aforesaid adjacent articles B.

The blank 10 comprises at least one end closure structure for at least partially closing an end of a tubular structure defined by the plurality of panels 12, 14*a*, 14*b*, 16, 18*b*, 18*a*, 20.

In the illustrated embodiment an end closure structure is provided for partially closing each end of the tubular structure.

Each of the end closure structures comprises a display window DW1, DW2 for the display of one or more articles B disposed adjacent thereto. In other embodiments one of the display windows may be omitted such that a display window is provided at only one end of the tubular structure, in other embodiments both the display windows DW1, DW2 may be omitted.

The blank 10 comprises a first end closure structure comprising a plurality of end closure panels 24*a*, 26*a*, 28*a*, 30*a*, 32*a*, 34*a*, 36*a*, 38*a*, 40*a*, 42*a*, 44*a*, 46*a*, 48*a*, 50*a*.

The first end closure structure comprises a top end closure flap 30*a*, hingedly connected to the top panel 16 by a fold line 31*a*. A first upper end closure flap 28*a* is hingedly connected to a first upper corner panel 42*a* by a fold line 43*a*. The first upper corner panel 42*a* is hingedly connected to the first upper side panel 14*b* by a fold line 29*a*. A second upper end closure flap 32*a* is hingedly connected to a second upper corner panel 48*a* by a fold line 45*a*, the second upper corner panel 48*a* is hingedly connected to the second upper side panel 18*b* by a fold line 33*a*.

Optionally, the first end closure structure comprises a first intermediate side end closure flap 26*a* hingedly connected to a first lower corner panel 40*a* by a fold line 41*a*; the first lower corner panel 40*a* is hingedly connected to the first lower side panel 14*a* by a fold line 27*a*. Optionally, the first end closure structure comprises a second intermediate side end closure flap 34*a* hingedly connected to a second lower corner panel 50*a* by a fold line 47*a*; the second lower corner panel 50*a* is hingedly connected to the second lower side panel 18*a* by a fold line 35*a*.

The first lower corner panel 40*a* may be hingedly connected to the first upper corner panel 42*a* by a fold line. The fold line may be contiguously arranged with the fold line 15 so as to be a collinear extension thereof.

The second lower corner panel 50*a* may be hingedly connected to the second upper corner panel 48*a* by a fold line. The fold line may be contiguously arranged with the fold line 21 so as to be a collinear extension thereof.

The first intermediate side end closure flap 26*a* may be coupled to the first upper side end closure flap 28*a* by a first web panel 44*a*. An aperture may be provided between the web panel 44*a* and the first upper corner panel 42*a* to separate a portion of the first upper side end closure flap 28*a* from a portion of the first intermediate side end closure flap 26*a*.

The second intermediate side end closure flap 34*a* may be coupled to the second upper side end closure flap 32*a* by a second web panel 46*a*. An aperture may be provided between the web panel 46*a* and the second upper corner panel 48*a* to separate a portion of the second upper side end closure flap 32*a* from a portion of the second intermediate side end closure flap 34*a*.

Optionally, the first end closure structure comprises a first lower side end closure flap 24*a*, hingedly connected to the first lower side panel 14*a* by a hinged connection in the form of a fold line 25*a*. Optionally, a second lower side end closure flap 36*a* is hinged to the second lower side panel 18*a* by a hinged connection in the form of a fold line 37*a*. Optionally, a bottom end closure flap 38*a* is hinged to the second base panel 20 by hinged connection in the form of a fold line 39*a*. The first lower side end closure flap 24*a*, second lower side end closure flap 36*a* and bottom end closure flap 38*a* are arranged to partially close a lower region of an open end of the tubular structure.

The blank 10 comprises a second end closure structure comprising a plurality of end closure panels 24*b*, 26*b*, 28*b*, 30*b*, 32*b*, 34*b*, 36*b*, 38*b*, 40*b*, 42*b*, 44*b*, 46*b*, 48*b*, 50*b*. The second end closure structure is substantially the same in construction as the first end closure structure and will not be described in further detail.

Optionally, the blank 10 comprises a carrying handle structure H1, H2 in each of the top end closure flaps 30*a*, 30*b*. The carrying handle structures H1, H2 may be employed by a user to carry the carton 90. The first top end closure flap 30*a* comprises a first carrying handle structure H1 having a first handle opening defined at least in part by a handle flap 60 struck from the first top end closure flap 30*a*. The handle flap 60 is hinged to the first top end closure flap 30*a* by a hinged connection in the form of a fold line 61. The handle flap 60 comprises a pair of fold lines 63, 65 extending from the fold line 61 to an opposing side edge of the handle flap 60 so as to define a pair of foldable end portions 62, 64. The pair of fold lines are arranged so as to diverge towards the fold line 61. The second top end closure flap 30*b* comprises a second carrying handle structure H2 which is substantially the same in construction as the first carrying handle structure H1 and will not be described in further detail.

Optionally, the blank 10 comprises a dispensing or access feature A for facilitating access to the contents of the carton 90. The access feature A comprises an access panel struck in part from the top panel 16, in part from the second upper side panel 18*b*, and in part from the second lower side panel 18*a*. The access panel A is defined by a weakened line of severance 53 formed as a continuous loop such that the access panel A is at least partially severable from the carton 90. The access feature A may comprise a tear initiation feature I comprising a pair of tabs T1, T2 hingedly connected to the second lower side panel 18*a* by respective fold lines and defined by a cutline interrupted by connecting portions or nicks so as to be readily severable. The tear initiation feature I defines a finger opening to enable engagement with the access panel A for removal thereof.

The first and second upper end closure flaps 28*a*, 32*a* may comprise a recessed or contoured free side edge opposing the respective hinged connection 43*a*, 45*a* to the first or second upper corner panel 42*a*, 48*a*. The contoured free side edges of the first and second upper end closure flaps 28*a*, 32*a* are shaped to facilitate the handle flap 60 being folded inwardly of the carton 90. The upper end closure flaps 28*b*, 32*b* of the second end closure structure may be similarly arranged.

The first lower corner panel 40*a* comprises a first lower free end edge opposite the hinged connection (when present) to the first upper corner panel 42*a*. The second lower corner panel 50*a* comprises a second lower free end edge opposite the hinged connection (when present) to the second upper corner panel 48*a*.

The first lower corner panel 40*a* terminates at the first lower free end edge. The first lower free end edge is distal from the first lower side end closure flap 24*a*, such that the first lower side panel 14*a* comprises a free edge portion, that is to say a portion of the side edge which is free from any hinged connection to the panels of the first side end closure structure.

The second lower corner panel 50*a* terminates at the second lower free end edge. The second lower free end edge is distal from the second lower side end closure flap 36*a*, such that the second lower side panel 18*a* comprises a free edge portion, that is to say a portion of a side edge which is free from any hinged connection to the panels of the second side end closure structure.

In embodiments where the first and second lower corner panels 40*a*, 50*a* and the first and second intermediate end closure flaps 26*a*, 34*a* are omitted, the first and second free lower edges are provided by the first and second upper corner panels 42*a*, 48*a*.

The corner panels 40*b*, 42*b*, 48*b*, 50*b* of the second end closure structure are similarly arranged to those of the first end closure structure.

The top panel 16 comprises a first length dimension $L_1$ extending between fold lines 31*a*, 31*b*. The first and second base panels 12, 20 comprise a second length dimension $L_2$ extending between free end edges of the first base panel 12 or between fold lines 39*a*, 39*b*. The second length dimension $L_2$ may be greater than the first length dimension $L_1$.

The top panel 16 comprises a first width dimension $W_1$ extending between fold lines 17, 19. The second base panel 20 comprises a second width dimension $W_2$. The second width dimension $W_2$ may be greater than the first width dimension $W_1$. In some embodiments, the second width dimension $W_2$ may be defined by both the first and second base panels 12, 20, and may be equivalent to the sum of the widths of the first and second base panels 12, 20 minus the width of a region of overlap between the first and second base panels 12, 20.

The blank 10 comprises an orientation adjustment device for enabling the orientation of an article B.

The orientation adjustment device is arranged such that the article B displayed in the display window W in the first side wall 14*a*/14*b* can be controlled or adjusted. It will be appreciated that the orientation adjustment device may be located such that one or both articles B presented in the display windows DW1, DW2 in the end walls of the carton 90 can be controlled or adjusted.

The orientation adjustment device comprises first cutaway or opening in the form of a lower aperture A5 provided in at least one of the first and second base panels 12, 20. In the illustrated embodiment the lower aperture A5 is provided in the first base panel 12.

In other embodiments the lower aperture A5 may be provided in the second base panel 20 or in part in each of the first and second base panels 12, 20.

The lower aperture A5 is arranged to be in vertical registry with the article B which is disposed in the display window W.

The lower aperture A5 may be shaped so as to comprise a "V" or "U" shaped cutaway portion which provides an alignment or assembly guide. This cutaway portion may be engaged by a tool 80 (see FIG. 11), for example of a packaging machine. The cutaway portion may facilitate alignment of the first base panel 12 with the second base panel 20 when the carton 90 is assembled about a group of articles B. Additionally or alternatively the cutaway portion may facilitate tightening or wrapping of the carton 90 about the group of articles B, it may facilitate pulling the first base panel 12 towards the second side panel 18*a*/18*b* so as to increase the degree of overlap between the first and second base panels 12, 20 such that the complementary locking mechanism may be employed.

The orientation adjustment device comprises a second cutaway or opening in the form of an upper aperture A6 provided at least in part in the top panel 16. In the embodiment of FIG. 7 the upper aperture A6 is provided in part in the top panel 16 and in part in the first upper side panel 14*b*. Extending the aperture A6 into the first upper side panel 14*b* may facilitate folding the top panel 16 with respect to the first upper side panel 14*b* along the fold line 17.

In other embodiments, the upper aperture A6 may be provided solely in the top panel 16, so as to be struck from only material forming the top panel 16. Such an arrangement may be advantageous when the article B is returned or lowered to a rest position within the interior chamber of the carton 90, an example of such an embodiment is illustrated in FIG. 12. In the embodiment of FIG. 12 the upper aperture A6 takes the form of a circular cutout struck from within the top panel 16.

In such alternative embodiments, a front or outer edge of the upper aperture A6 is provided by the top panel 16 and therefore is oriented horizontally or perpendicularly with respect to a direction of travel of the article B as it moves, or descends, into the carton 90. This may reduce the likelihood of a portion of the article B such as a flange or cap or other closure, from being caught or snagged upon material defining an edge of the upper aperture A6.

The upper aperture A6 is arranged to be in vertical registry with the upper end of the article B which is disposed in the display window W. The upper aperture A6 is dimensioned such that an upper portion of said article B can pass through the top panel 16.

Figure 9:
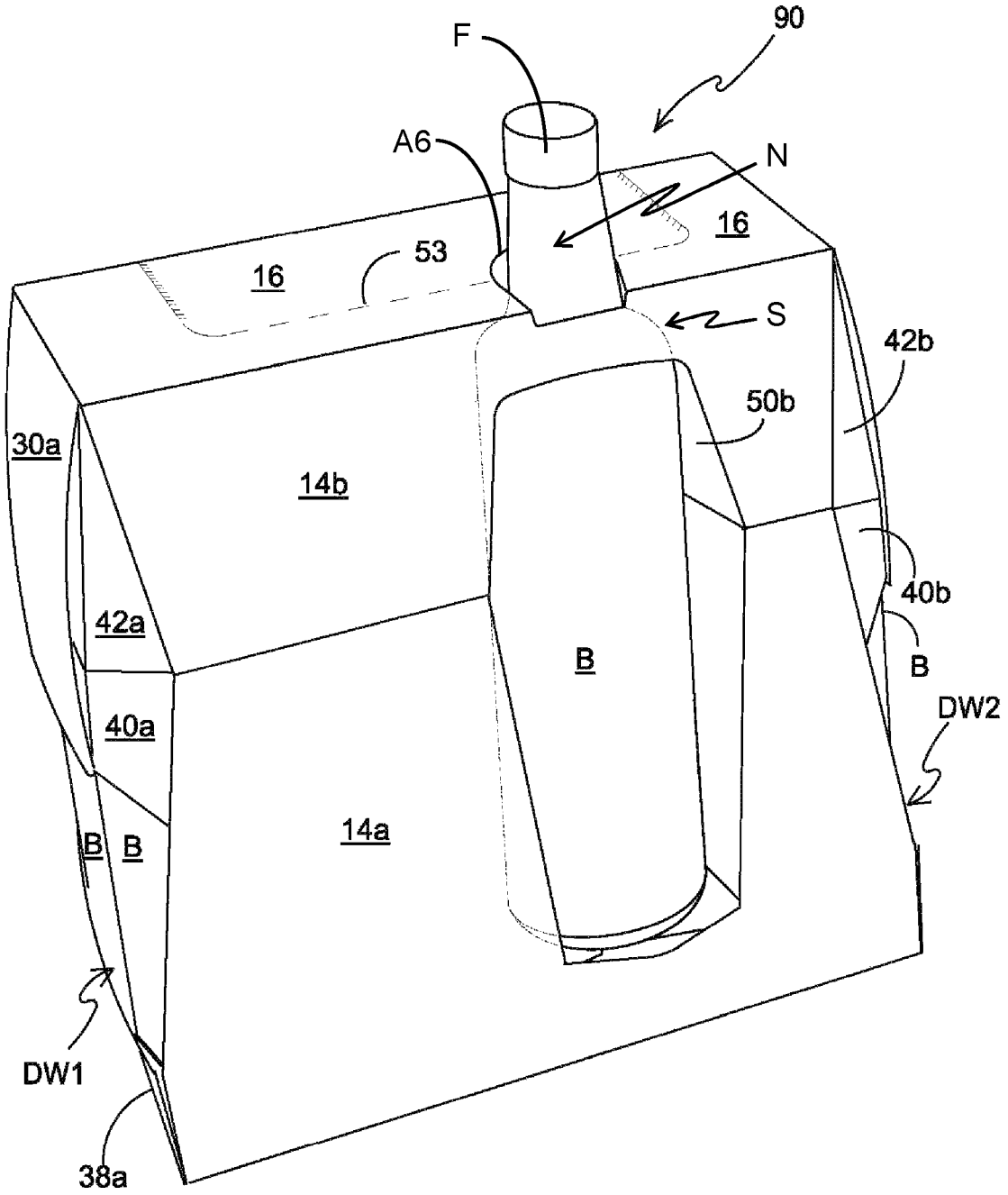

The upper aperture A6 may be dimensioned so as to be smaller than a shoulder portion of the article B. In this way an upper end portion of the article B may pass through the upper aperture A6 but is prevented from being fully withdrawn through the upper aperture A6. When the article B is a bottle, the "finish" F, and at least some of the "neck" N may be positioned externally of the carton 90. The "shoulder" S, "body" and "heel" of the bottle, being retained within the carton 90, as shown in FIGS. 9 to 11.

In embodiments having a dispensing or access feature A the upper aperture A6 may interrupt the weakened line of severance 53. The upper aperture A6 may serve to facilitate removal of the access panel Turning to the construction of the carton 90 as illustrated in FIGS. 8 to 11, the carton 90 can be formed by a series of sequential folding operations in a straight line machine so that the carton 90 is not required to be rotated or inverted to complete its construction. The folding process is not limited to that described below and may be altered according to particular manufacturing requirements.

A group of articles B is assembled; in the preferred embodiment eight articles B are arranged in a 4×2 array. The top panel 16 of the blank 10 is disposed above the group of articles B to provide a top wall 16 of the carton 90.

The window panels 50*a*, 50*b* are folded inwardly of the carton either prior to or simultaneously with the first and second side walls 14*a*/14*b*, 18*a*/18*b* being folded about the fold lines 17, 19 so as to be disposed on opposing sides of the group of articles B. The window panels 50*a*, 50*b* are disposed such that they are interposed between a pair of adjacent articles B. Folding the window panels 50*a*, 50*b* in this manner warps the corresponding one of the first or second side walls 14*a*/14*b*, 18*a*/18*b* to which they are attached due to the non-linear nature of the fold lines 51*a*, 51*b*, 51*c*, 51*d* connecting the window panels 50*a*, 50*a* to the first side wall 14*a*/14*b*. The warping of the first side wall 14*a*/14*b* urges the window panels 50*a*, 50*b* against the article B.

Once the first and second sidewalls 14*a*/14*b*, 18*a*/18*b* are folded about the opposing sides of the group of articles B; the first base panel 12 is folded about the fold line 13 so as to be disposed adjacent the base of the group of articles B. The second base panel 20 is then folded about the fold line 23 so as to be in at least partial overlapping relationship with the first base panel 12. The first and second base panels 12, 20 are secured together. Each of the male tabs M is displaced inwardly out of the plane of the second base panel 20. In so doing, each of the female tabs F is displaced inwardly creating a corresponding opening in the first base panel 12. The male tabs M are received in respective ones of the openings so as to lock the first and second base panels 12, 20 together. In this way a tubular structure is formed about the group of articles B.

In some embodiments, the blank 10 may be formed into a tubular structure and subsequently loaded with articles B through at least one open end thereof.

The first and second end closure structures are folded about the open ends of the tubular structure. The folding sequence for each of the first and second end closure structures is substantially the same and will be described in more detail by reference to the first end closure structure only.

The first and second upper side end closure flaps 28*a*, 32*a* and the first and second upper corner panels 42*a*, 48*a* are folded about the fold lines 29*a*, 33*a*, 43*a*, 45*a* so as to partially close a first open end of the tubular structure.

The first and second intermediate side end closure flaps 26*a*, 34*a* and the first and second lower corner panels 40*a*, 50*a*, when present, are also folded, about the fold lines 27*a*, 35*a*, 41*a*, 47*a*.

The first upper side end closure flap 28*a* may be secured to the second upper side end closure flap 32*a*. In some embodiments the first and second upper side end closure flaps 28*a*, 32*a* may be dimensioned so as to be arranged in an at least partial overlapping arrangement. Glue or other adhesive treatment may be applied to one of the first and second upper side end closure flaps 28*a*, 32*a* so as to secure them together. Similarly, the first intermediate side end closure flap 26*a* may be secured to the second intermediate side end closure flap 34*a*. In some embodiments the first and second intermediate side end closure flaps 26*a*, 34*a* may be dimensioned so as to be arranged in an at least partial overlapping arrangement. Glue or other adhesive treatment may be applied to one of the first and second intermediate side end closure flaps 26*a*, 34*a* so as to secure them together.

The top end closure flap 30*a* is folded about fold line 31*a* so as to be brought into face contacting relationship with the first and second upper side end closure flaps 28*a*, 32*a* and optionally with the first and second intermediate side end closure flaps 26*a*, 34*a*. Glue or other adhesive treatment may be applied to first and second upper side end closure flaps

28*a*, 32*a*, the first and second intermediate side end closure flaps 26*a*, 34*a* or the top end closure flap 30*a* so as to secure them together.

The first and second lower side end closure flaps 24*a*, 36*a*, when present, are folded about the fold lines 25*a*, 37*a*. The first lower side end closure flap 24*a* may be secured to the second lower side end closure flap 36*a*. In some embodiments the first and second lower side end closure flaps 24*a*, 36*a* may be dimensioned so as to be arranged in an at least partial overlapping arrangement. Glue or other adhesive treatment may be applied to one of the first and second lower side end closure flaps 24*a*, 36*a* so as to secure them together.

The bottom end closure flap 38*a* is folded about fold line 39*a* so as to be brought up into face contacting relationship with the first and second lower side end closure flaps 24*a*, 36*a*.

FIGS. 8 to 11 illustrate a carton 90 in which a first side wall 14*a*/14*b* comprises a first display window W exposing to view an article B. The pair of displaceable flaps 50*a*, 50*b* form a frame about the article B, best shown in FIG. 8. The article B is shown in a first rest position in FIG. 8.

The article B presented in the first display window W in the first side wall 14*a*/14*b* is moveable or translatable, as indicated by direction arrow D8, within the assembled carton 90. A finger or tool 80 can be inserted through the base wall 12/20 formed by the first and second base panels 12, 20, as shown in FIG. 11. The finger or tool 80 can be employed to push the article B away from the base wall 12/20.

When the article B is moved an upper portion passes through the upper aperture A6 and is external of the carton 90 as shown in FIGS. 9 to 11. In this second deployed position the article B is readily accessible. The orientation of the article B may be adjusted in the deployed position, upon reaching the desired orientation the article B may be returned to the rest position.

The carton 90 may comprise at least one second display window DW1, DW2 defined in or by an end wall. The second display window DW1, DW2 exposes to view a pair of endmost articles B, particularly a label or other indicia printed or otherwise displayed on a lower or main body portion of the articles B. The articles B comprise a main body and a neck portion disposed above the main body; the neck portion comprises a smaller dimension or diameter than the main body. A shoulder region provides a transition between the main body and the neck portion. The top end closure flap 30*a* is configured to obscure from view at least the neck portion. In some embodiments, the shoulder region or an upper portion of the main body or both may be obscured from view by the top end closure flap 30*a*, 30*b*.

The second display window DW1, DW2 is defined in part by free side edge portions of each of the first and second side walls 14*a*, 18*a*.

In this way branding or other indicia provided upon the articles B may be displayed through the first display window W or second display window DW1, DW2. The articles B may be arranged in a desired orientation. The displaceable flaps 50*a*, 50*b* may bear against an article B so as to prevent or inhibit rotation of the article B away from the desired orientation.

The first and second end closure structures may be tightened so as to bear against the endmost articles B so as to prevent or inhibit rotation of the articles B away from a predefined orientation. For example, portions of the first or second corner panels 40*a*/42*a*, 48*a*/50*a*, such as but not limited to a lower free edge, may bear against a respective one the endmost articles B. The first and second upper side end closure flaps 28*a*, 32*a* or the first and second intermediate side end closure flaps 26*a*, 34*a* may engage the endmost articles B, with frictional forces therebetween preventing or inhibiting rotation of the articles B.

The first and second upper side end closure panels 28*a*, 32*a* may be aligned with, or arranged to bear against, a cap or closure portion at an upper end of an adjacent article B.

The first and second intermediate side end closure panels 26*a*, 34*a* may be aligned with, or arranged to bear against, the shoulder portion or main body of an adjacent article B.

Returning to FIGS. 1 to 6, the packaging machine 100 comprises a second conveyor 122 which forms an article displacement apparatus. In the illustrated embodiment second conveyor 122 is disposed below the first conveyor 120. In this way the second conveyor 122 and the orientation tool 110 face opposing surfaces of the packages 91. The second conveyor 122 is disposed proximate a top panel of the packages 91. The orientation tool 110 is disposed proximate a base panel of the packages 91.

It will be appreciated that in other embodiments, the packages 91 may be placed upon the first conveyor so as to rest upon a side wall 14*a*/14*b*, 18*a*, 18*a*/18*b* or an endwall. In such embodiments the position of the second conveyor 122 and orientation tool 110 with respect to the first conveyor 120 may be adjusted accordingly.

The second conveyor 122 comprises a chain or belt arranged in an endless loop. The second conveyor 122 is coupled to a two or more wheels in the form of sprockets or pulley wheels, one of the wheels is driven by a drive mechanism such as a rotary drive motor.

The second conveyor 122 comprises a plurality of lugs 126. The lugs 126 face outward of the chain or belt. The lugs 126 are arranged to be received in the lower aperture A5 in the base panel 12/20 of the carton 90.

The second conveyor 122 comprises a working reach; in the working reach, the second conveyor 122 conveys the lugs 126 in the downstream direction D1. The second conveyor 126 conveys the lugs 126 in synchronicity with the packages 91 upon the first conveyor 120.

The second conveyor 122 comprises a return reach; in the return reach, the second conveyor 122 conveys the lugs 126 in an upstream direction.

Figure 6:
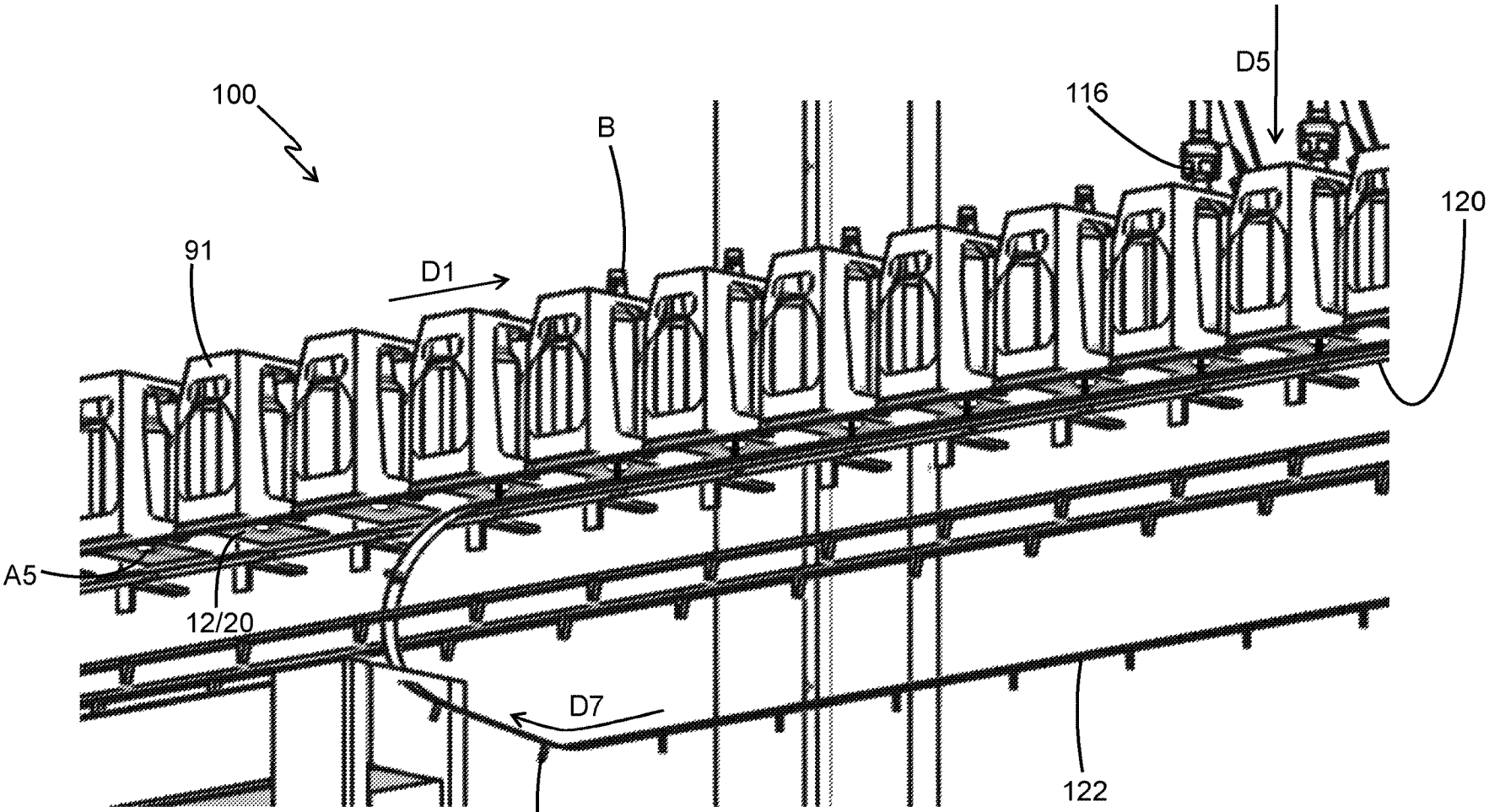
FIG. 6 is a further perspective view of the subsystem of FIG. 1.

As illustrated in FIG. 6, the second conveyor 122 brings a lug 126 into engagement with an article B in a respective package 91. The lugs 126 form an article displacement or pushing tool which engages with (optionally, the lugs 126 engage with an end or base of the article B) and moves the article B away from a wall of the carton (in the illustrated embodiment the wall is formed from the base panel 12/20), in doing so an upper portion of the article B passes through another wall of the carton (in the illustrated embodiment, this is an opposing wall formed by the top panel 16). In this way the second conveyor 122 elevates or displaces said article B such that the upper portion protrudes through the top panel 16. The second conveyor 122 maintains said article B in an elevated or protruding position throughout the working reach.

The orientation tool 110 is able to engage with one or more elevated articles B during at least a portion of the working reach of the second conveyor 122.

Figure 3:
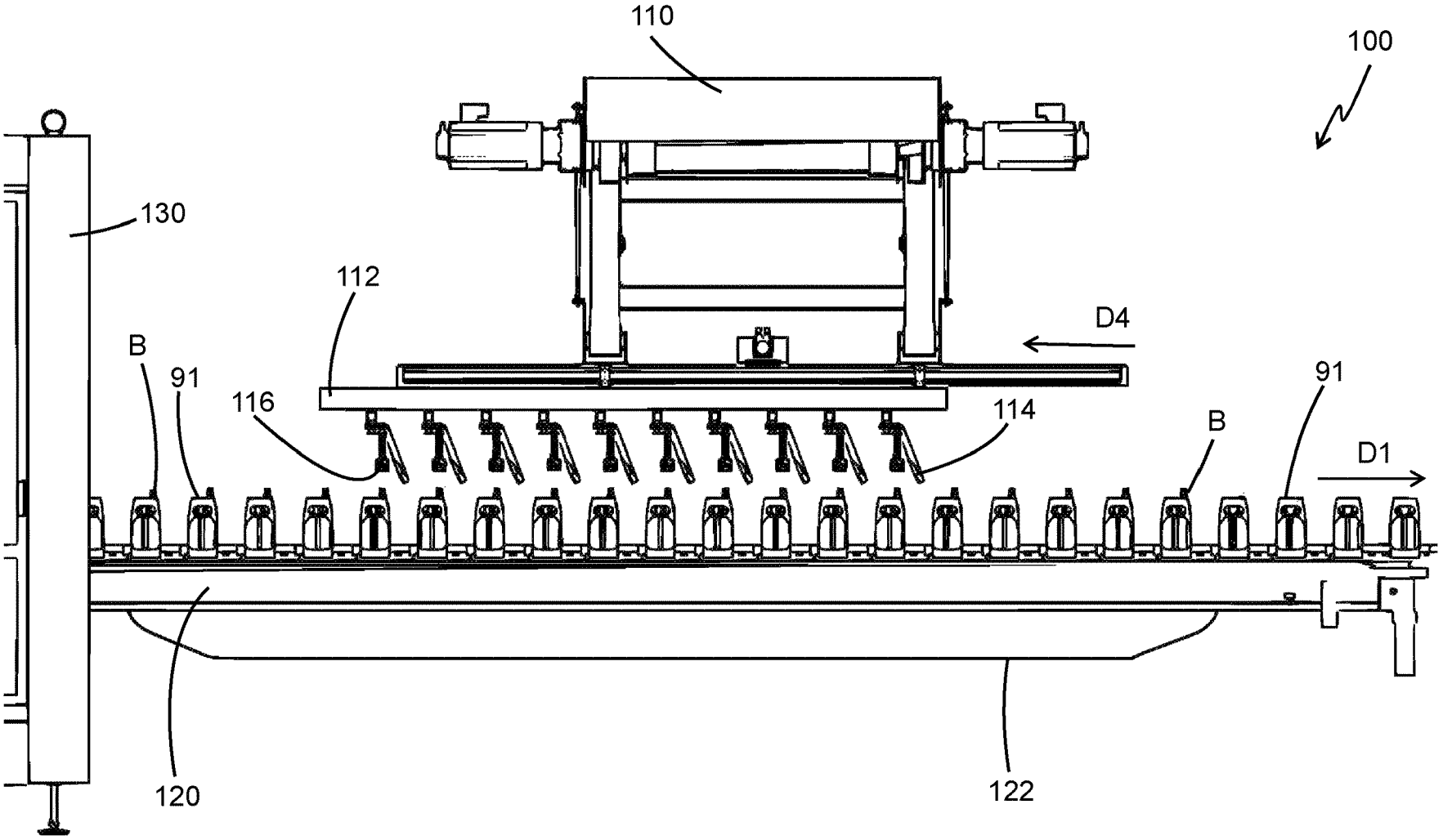
FIGS. 3 to 5 are side view of the subsystem of FIG. 1 in stages of use.
Figure 4:
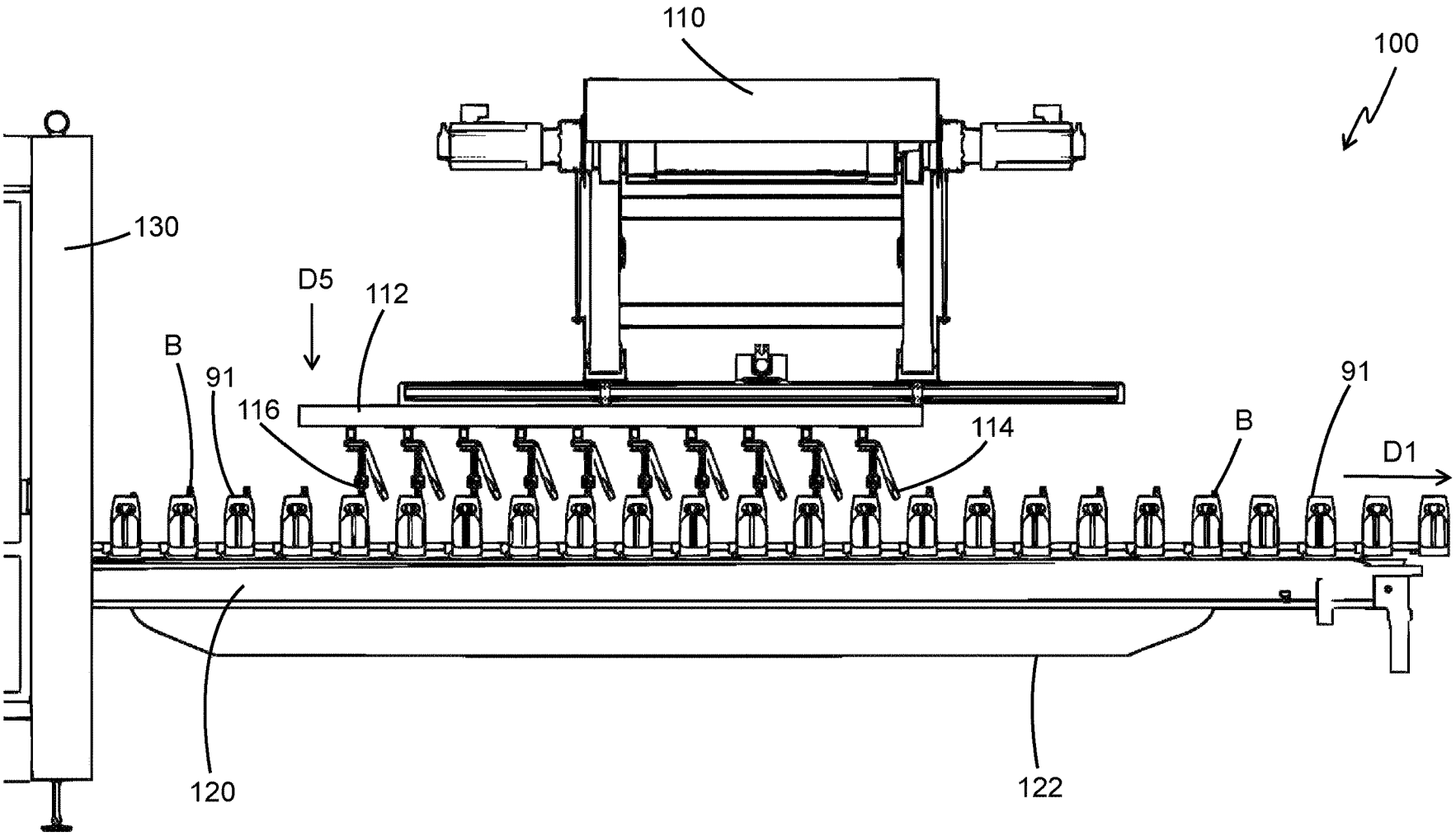
Figure 5:
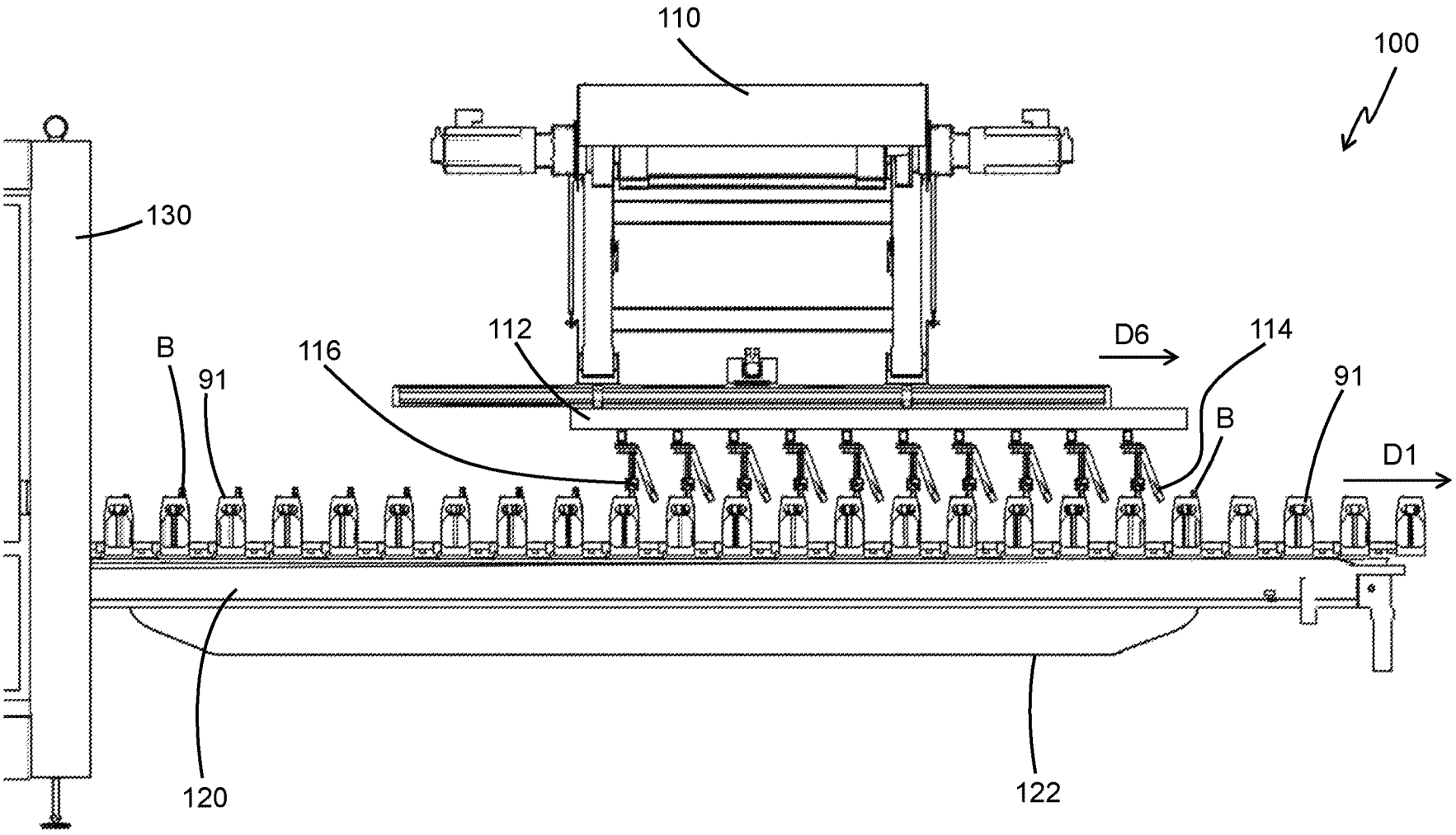

FIGS. 3 to 5 illustrate the orientation tool 110 at several stages of operation. In FIG. 3 the tool head 112 has moved to an upstream position as indicated by direction arrow D4. The tool head 112 is then lowered to bring each of the article grippers 116 into engagement with an elevated article B of a respective package 91. The tool head 112 is moved downstream, synchronously with the packages 91 as they are conveyed upon the first conveyor 120, simultaneously as the tool head 112 is lowered in the direction D5 shown in FIG. 4. In the illustrated embodiment, the packages 91 are continuously moved downstream by the first conveyor 120. The orientation tool 110 moves the tool head 112 further downstream, as indicated by direction arrow D6, while the article grippers 116 are in engagement with the elevated articles B.

Figure 2:
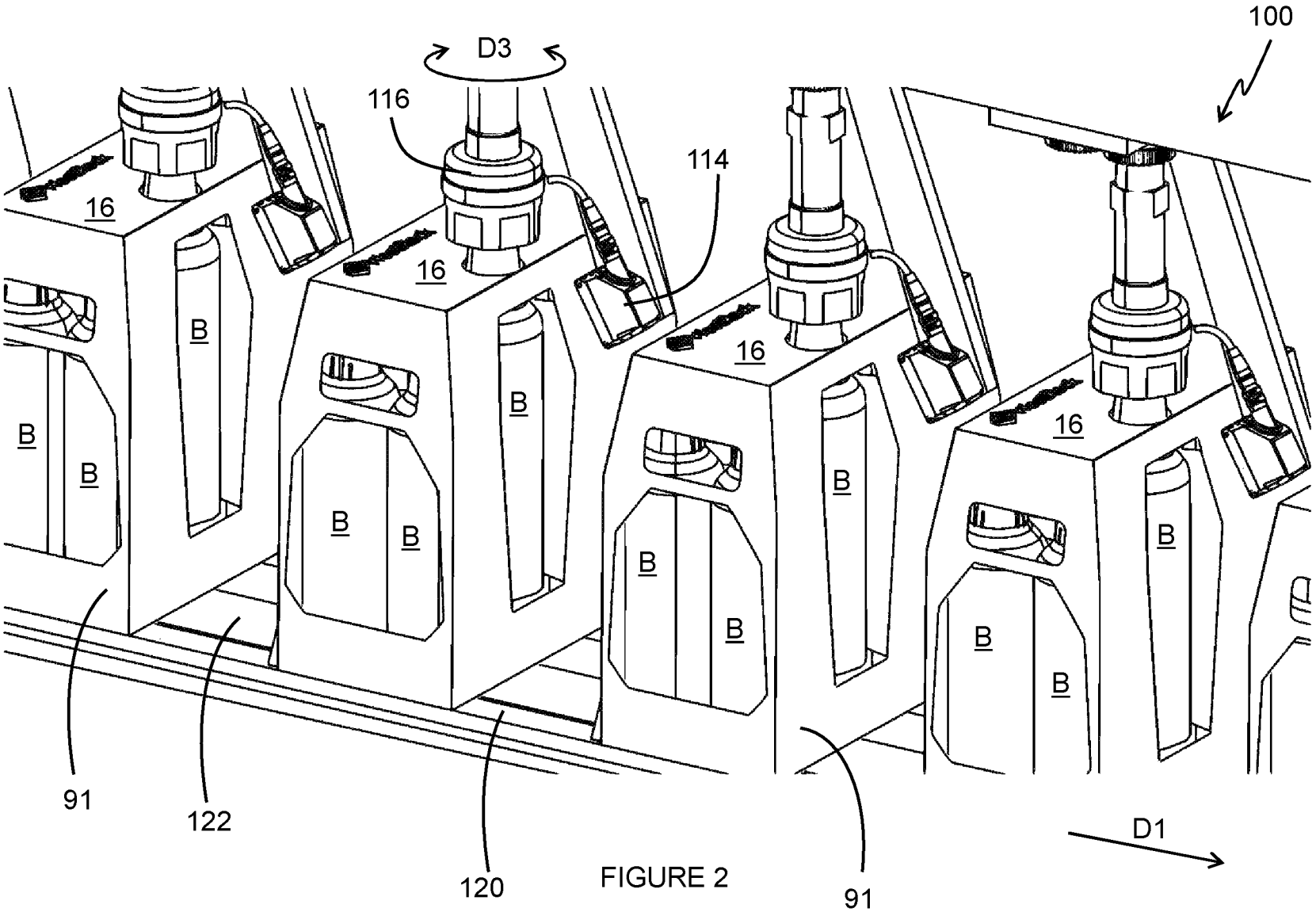
FIG. 2 is an enlarged perspective view of a portion of the subsystem of FIG. 1.

Whilst the article grippers 116 are in engagement with the elevated articles B the orientation tool 110 adjusts the orientation of the elevated articles B, as indicated by direction arrow D3 in FIG. 2.

The article grippers 116 are disengaged from the elevated articles B and the tool head 112 is moved upwardly. The tool head 112 returns to the upstream position of FIG. 3 and the process repeats which a subsequent set of packages 91.

When the packages 91 reach the end of the working reach of the second conveyor 122, the lugs 126 are withdrawn from the cartons 90 and disengaged from the displaceable articles B. The lugs 126 are subsequently returned upstream to engage with subsequent packages 19 entering the article manipulation apparatus 101.

The present disclosure provides packaging machine and a method of packaging articles in a carton wherein the orientation of at least one article is adjustable. The packaging machine comprises an orientation tool for engaging an article. The packaging machine comprises an article pushing tool for moving an article from a first position in which it is disposed within a carton to a second position in which a portion of the article protrudes through a wall of the carton. The orientation tool arranged to engage with the article in the second position and to adjust the orientation of the article with respect to the carton.

The present disclosure further provides a method of packaging articles or a method of assembling a carton, in which the method enables the position of one or more articles, or the orientation of said one or more articles, or both the position and orientation of said one or more articles, to be adjusted and optionally secured or held whilst within the carton.

The carton may have at least one display window for presentation of an article therein. The carton comprises a plurality of panels forming walls of a tubular structure including a top wall, a first side wall, a base wall, and a second side wall, optionally hingedly connected to each other in a linear series.

The carton comprises an orientation adjustment device for enabling the orientation of an article B which is at least partially exposed to view through the display window. The orientation adjustment device comprises a first cutaway in the form of an aperture or opening in a first panel of the carton. The orientation adjustment device comprises a second cutaway in the form of an aperture or opening in a second panel of the carton, wherein the second panel opposes the first panel. The first panel may be a base panel and the second panel may be a top panel.

The first cutaway is configured to allow access to a first end, optionally a base portion, of an article. The first cutaway is configured to prevent the first end of the article passing therethrough. The second cutaway configured to allow a second, opposing, end portion of the article, optionally a top or upper portion of the article pass through.

The article may comprise a shoulder or other transition region and a main body portion, the second cutaway is configured to prevent or inhibit the article from being fully withdrawn therethrough. The second cutaway is configured to be smaller in dimension than the transition region or the main body portion or both the transition region and the main body portion.

The top wall of the carton may be shorter than the base wall in a longitudinal direction parallel to a tubular axis of the tubular structure formed by the plurality of main panels.

The top wall of the carton may be shorter than the base wall in a transverse direction perpendicular to the tubular axis of the tubular structure formed by the plurality of main panels.

It can be appreciated that various changes may be made within the scope of the present invention. For example, the size and shape of the panels and apertures may be adjusted to accommodate articles of differing size or shape.

It will be recognised that as used herein, directional references such as "top", "bottom", "base", "front", "back", "end", "side", "inner", "outer", "upper" and "lower" do not necessarily limit the respective panels to such orientation, but may merely serve to distinguish these panels from one another.

As used herein, the terms "hinged connection" and "fold line" refer to all manner of lines that define hinge features of the blank, facilitate folding portions of the blank with respect to one another, or otherwise indicate optimal panel folding locations for the blank. Any reference to "hinged connection" should not be construed as necessarily referring to a single fold line only; indeed a hinged connection can be formed from two or more fold lines wherein each of the two or more fold lines may be either straight/linear or curved/curvilinear in shape. When linear fold lines form a hinged connection, they may be disposed parallel with each other or be slightly angled with respect to each other. When curvilinear fold lines form a hinged connection, they may intersect each other to define a shaped panel within the area surrounded by the curvilinear fold lines. A typical example of such a hinged connection may comprise a pair of arched or arcuate fold lines intersecting at two points such that they define an elliptical panel therebetween. A hinged connection may be formed from one or more linear fold lines and one or more curvilinear fold lines. A typical example of such a hinged connection may comprise a combination of a linear fold line and an arched or arcuate fold line which intersect at two points such that they define a half moon-shaped panel therebetween.

As used herein, the term "fold line" may refer to one of the following: a scored line, an embossed line, a debossed line, a line of perforations, a line of short slits, a line of half-cuts, a single half-cut, an interrupted cutline, a line of aligned slits, a line of scores and any combination of the aforesaid options.

It should be understood that hinged connections and fold lines can each include elements that are formed in the substrate of the blank including perforations, a line of perforations, a line of short slits, a line of half-cuts, a single half-cut, a cutline, an interrupted cutline, slits, scores, any combination thereof, and the like. The elements can be dimensioned and arranged to provide the desired functionality. For example, a line of perforations can be dimensioned or designed with degrees of weakness to define a fold line and/or a severance line. The line of perforations can be designed to facilitate folding and resist breaking, to facilitate folding and facilitate breaking with more effort, or to facilitate breaking with little effort.

The phrase "in registry with" as used herein refers to the alignment of two or more elements in an erected carton, such as an aperture formed in a first of two overlapping panels and a second aperture formed in a second of two overlapping panels. Those elements in registry with each other may be aligned with each other in the direction of the thickness of the overlapping panels. For example, when an aperture in a first panel is "in registry with" a second aperture in a second panel that is placed in an overlapping arrangement with the first panel, an edge of the aperture may extend along at least a portion of an edge of the second aperture and may be aligned, in the direction of the thickness of the first and second panels, with the second aperture.

The invention claimed is:

1. A packaging machine for packaging articles comprising an article manipulation apparatus, the article manipulation apparatus comprising:

a first conveyor for conveying packages, the packages each comprising a carton having at least one displaceable article disposed therein;

an article orientation device comprising a tool head movable in a downstream direction of the first conveyor for a first stroke, and movable in an upstream direction for a second stroke, and having at least one article gripper for engaging with a displaceable article in a carton, the at least one article gripper being rotatably mounted to the tool head, wherein the tool head is configured to reciprocate between the first stroke and the second stroke with the at least one article gripper engaged with at least one respective displaceable article for the first stroke, and disengaged from the at least one respective displaceable article for the second stroke;

at least one sensor for determining the orientation of the displaceable article;

a drive mechanism for rotating the at least one article gripper to place the displaceable article in a predefined orientation; and an article displacement device comprising a first working reach, wherein the article displacement device engages with the displaceable article over the first working reach so that the displaceable article is moved relative to the carton.

2. A packaging machine according to claim 1 wherein the carton comprises a plurality of panels forming walls of a tubular structure including a top wall, a first side wall, a base wall, and a second side wall, the carton comprises a top opening defined at least in the top wall for receiving an upper portion of said displaceable article and a bottom opening defined at least in the base wall to access said displaceable article to raise and lower the elevation thereof such that the upper portion of said displaceable article is movable upward and downward through the top opening.

3. A packaging machine according to claim 2 wherein the carton comprises a display window defined at least in the first side wall for display of said displaceable article.

4. A packaging machine according to claim 1 wherein the packages are continuously moved in a downstream direction upon the first conveyor through the article manipulation apparatus.

5. A packaging machine according to claim 1 wherein the carton comprises at least one further article, the carton being configured to inhibit displacement of said at least one further article.

6. A packaging machine according to claim 1 wherein the article displacement device comprises an article pushing tool receivable in an opening in the carton to displace the displaceable article such that it protrudes from the carton.

7. A packaging machine according to claim 6 wherein the article displacement device comprises a second working reach, and one of the at least one article gripper is moveable in synchronicity with the article pushing tool over the second working reach.

8. A packaging machine according to claim 6, wherein the article pushing tool is on a conveyor arranged in an endless loop.

9. A packaging machine according to claim 6, wherein the article pushing tool is movable synchronously in a downstream direction with the first conveyor.

10. A method of packaging one or more articles comprising:

providing at least one article in a carton, the carton comprising a plurality of panels forming walls of a tubular structure including a first wall, a second wall opposing the first wall, the first and second wall being spaced apart by at least a third wall, a first opening defined at least in the first wall for receiving a portion of said article and a second opening defined at least in the second wall to access a displaceable article within the carton;

engaging a portion of the displaceable article with a second tool along a first stroke of the second tool, wherein the second tool moves synchronously in a downstream direction with the displaceable article;

determining the orientation of the displaceable article with respect to the carton;

rotating the second tool so as to rotate the displaceable article into a desired orientation with respect to the carton;

disengaging the second tool from the displaceable article; and returning the second tool along a second stroke in an upstream direction for orientation of a subsequent displaceable article.

11. A method according to claim 10 further comprising:

inserting a first tool, through the second opening, into the carton so as to engage with the displaceable article; and pushing the displaceable article from an initial position so as to displace it with respect to the carton such that a portion of the displaceable article protrudes though the first opening.

12. A method according to claim 11 comprising withdrawing the first tool from the carton so as to return the displaceable article to the initial position, wherein in the initial position the displaceable article is disposed within an interior chamber of the carton.

13. An article manipulation apparatus for a packaging machine, the article manipulation apparatus comprising:

a first conveyor for conveying a plurality of grouped articles comprising a displaceable article and a non-displaceable article;

an article orientation device comprising a tool head movable synchronously in a downstream direction with the first conveyor for a first stroke, and movable in an upstream direction for a second stroke, wherein the tool head comprises an article gripper rotatably mounted to the tool head and configured to engage with the displaceable article while remaining unengaged with the non-displaceable article, wherein the tool head is configured to reciprocate between the first stroke and the second stroke with the article gripper engaged with the displaceable article for the first stroke, and disengaged from the displaceable article for the second stroke in which the tool head moves in the upstream direction;

at least one sensor for determining the orientation of the displaceable article;

a drive mechanism for rotating the article gripper to place the displaceable article in a predefined orientation; and an article displacement device comprising a first working reach, wherein the article displacement device engages with the displaceable article over the first working reach so that the displaceable article is moved relative to the carton.

14. An article manipulation apparatus according to claim 13 wherein the article displacement device comprises an article pushing tool receivable in an opening in a carton in which the plurality of grouped articles is packaged to displace the displaceable article such that it protrudes from the carton.

15. An article manipulation apparatus according to claim 14, wherein the article pushing tool is on a conveyor arranged in an endless loop.

16. An article manipulation apparatus according to claim 14, wherein the article pushing tool is movable synchronously in a downstream direction with the first conveyor.

17. An article manipulation apparatus according to claim 14, wherein the article displacement device comprises a second working reach, and the article gripper is moveable in synchronicity with the article pushing tool over the second working reach.

* * * * *